United States Patent [19]

Pavel et al.

[11] Patent Number: 4,765,473

[45] Date of Patent: Aug. 23, 1988

[54] OVERCASE FOR SEWING MACHINE NEEDLE PACKAGES

[75] Inventors: Klaus Pavel, Eynatten, Belgien; Horst Lange, Aachen, both of Fed. Rep. of Germany

[73] Assignee: Rhein-Nadel Maschinennadel GmbH, Fed. Rep. of Germany

[21] Appl. No.: 914,333

[22] Filed: Oct. 2, 1986

[30] Foreign Application Priority Data

Oct. 12, 1985 [DE] Fed. Rep. of Germany ... 8529110[U]

[51] Int. Cl.[4] ..... B65D 85/28

[52] U.S. Cl. ..... 206/380; 206/383; 220/4 B; 220/DIG. 25

[58] Field of Search ..... 206/45.34, 380, 382, 206/383; 220/DIG. 25, 4 B, 4 E; 40/152, 152.1

[56] References Cited

U.S. PATENT DOCUMENTS

| | | | |
|---|---|---|---|
| 93,499 | 8/1869 | Timby | 206/383 |
| 2,620,941 | 12/1952 | Smulski | 220/DIG. 25 |
| 2,712,880 | 7/1955 | Moore | 220/4 B |
| 2,731,167 | 1/1956 | Moore | 220/4 B |
| 3,032,228 | 5/1962 | Andrews | 220/4 E |
| 3,111,489 | 11/1963 | Getzin | 220/4 B |
| 3,469,687 | 9/1969 | Schneider | 206/382 |
| 3,645,025 | 2/1972 | Giesecke | 220/4 E |
| 3,842,974 | 10/1974 | Jacobsen | 206/45.34 |
| 3,935,944 | 2/1976 | Wilson et al. | 206/45.34 |
| 3,950,603 | 4/1976 | Brefka | 220/4 B |
| 4,002,287 | 1/1977 | Saveth | 220/DIG. 25 |
| 4,186,073 | 1/1980 | Paganomi | 206/380 |
| 4,390,217 | 6/1983 | Wagner | 220/DIG. 25 |

FOREIGN PATENT DOCUMENTS

| | | | |
|---|---|---|---|
| 7808823 | 9/1978 | Fed. Rep. of Germany . | |
| 2315453 | 1/1977 | France | 220/4 B |

*Primary Examiner*—David T. Fidei

*Attorney, Agent, or Firm*—Wood, Herron & Evans

[57] ABSTRACT

An overcase for needle packages is disclosed. The overcase includes a U-shaped bottom member and a U-shaped cover member. These members are slidably engaged with their respective shanks offset by 90°. The shanks of the cover include depressed central panels which form guide surfaces. Cooperating guide shoulders are formed on the shanks of the bottom member. The lower ends of the cover member shanks carry projections engageable in recesses formed in the bottom member.

6 Claims, 4 Drawing Sheets

OVERCASE FOR SEWING MACHINE NEEDLE PACKAGES

BACKGROUND OF THE INVENTION

The invention relates to an overcase for sewing machine needle packages which comprises a bottom part and a cover part which can be slipped on the former, the two together forming side walls, a bottom wall and a top wall.

Such overcases allow an orderly, protected accommodation of packages each containing a small number of needles, for instance, ten pieces. Such an overcase is disclosed in German Utility Patent No. 78 08 823.

SUMMARY OF THE INVENTION

The problem underlying the invention is to provide an overcase for needle packages which is easy to handle and stable in use while being simple to manufacture.

In accordance with the present invention, this problem is solved by providing an overcase including a bottom part and a cover part each having a U-shaped design, the parts being slipped together with their U-shanks mutually offset by 90°, with the U-shanks of the cover part being guided between the marginal edges of the U-shanks of the bottom part.

One advantage of the present overcase is that it is simple to manufacture. In addition, the overcase is simple to open. The shanks of the U-shapes are available as gripping surfaces over practically their entire area. With both hands in an offset clasping grip, the overcase can be conveniently opened by pulling the U-shaped parts, and can be easily closed by pushing the parts together. The two parts are held by a retention force which, in conjunction with the flexibility of the U-shanks, results in a secure retention of the sewing machine needle packages inserted in the overcase. These packages bear against the shanks but are held so that they cannot slip out even if the package is overturned with the U-opening of the bottom part pointing down. The U-shanks act like clamping jaws to remain in engagement with one another. With the cover part removed, the contents are exposed to convenient viewing and removal. The gripping opening which has been exposed extends on both sides over practically the entire height of the bottom part. Consequently, handling of the needle packages and individual needles is facilitated. In a preferred embodiment the ends of the cover part U-shanks bearing on the marginal edges of the U-shanks of the bottom part lock in depressions in the U-web of the bottom part. This effectively prevents the two case-forming components from accidently separating from each other; rather a deliberate effort is required to open the overcase. The selective locking action of the two package parts is assisted by the provision of free-standing U-shanks in the bottom and cover parts. The inside surfaces of the U-shanks of the cover part include guide shoulders formed on inwardly extending central panel portions. The marginal edges of the cover part web include protruding ledges. These ledges provide a stable attachment of the U-shanks to the U-web. Safe retention of the inserted sewing machine needle packages in the overcase is facilitated by providing the U-shanks and the U-web of the bottom part with support shoulders which protrude inwardly. These shoulders additionally provide increased stability by forming angular portions along the longitudinal marginal edges of the U-shanks and U-web.

The objects and advantages of the invention will be more fully explained hereafter with the aid of an illustrated embodiment.

DESCRIPTION OF A PREFERRED EMBODIMENT

One preferred form of overcase for sewing machine needle packages 1 consists of a bottom part U and a cover part D.

Figure 1:
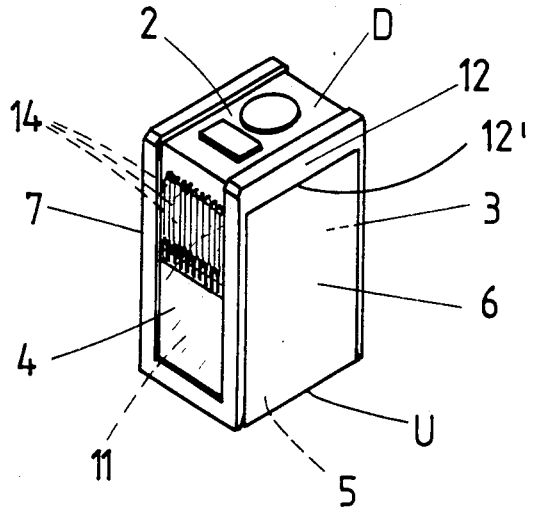
FIG. 1 is a perspective view of a preferred embodiment of the present invention.
Figure 2:
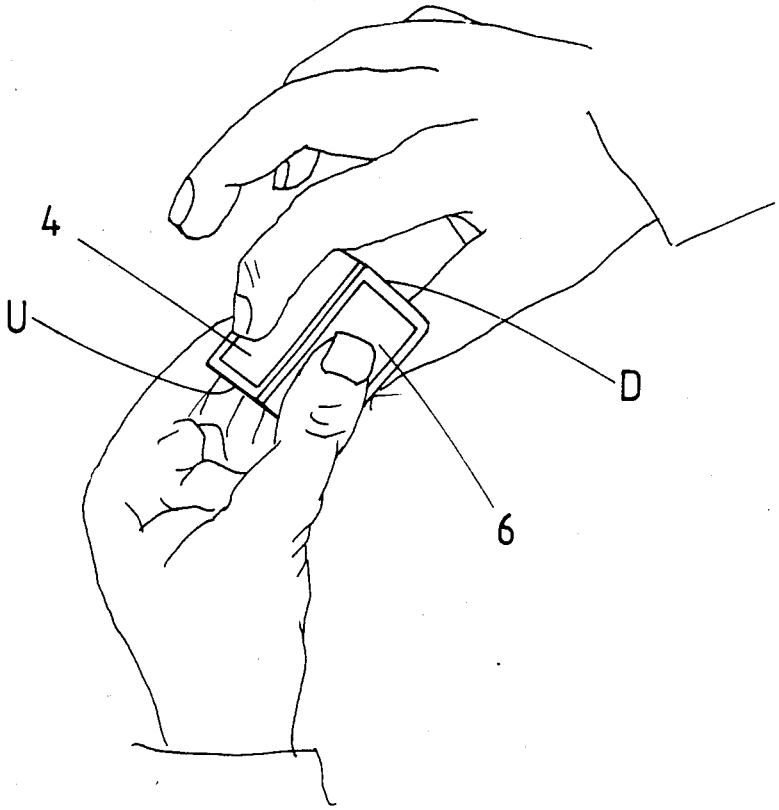
FIG. 2 is a perspective view illustrating the convenient gripping for opening and closing of the overcase.
Figure 3:
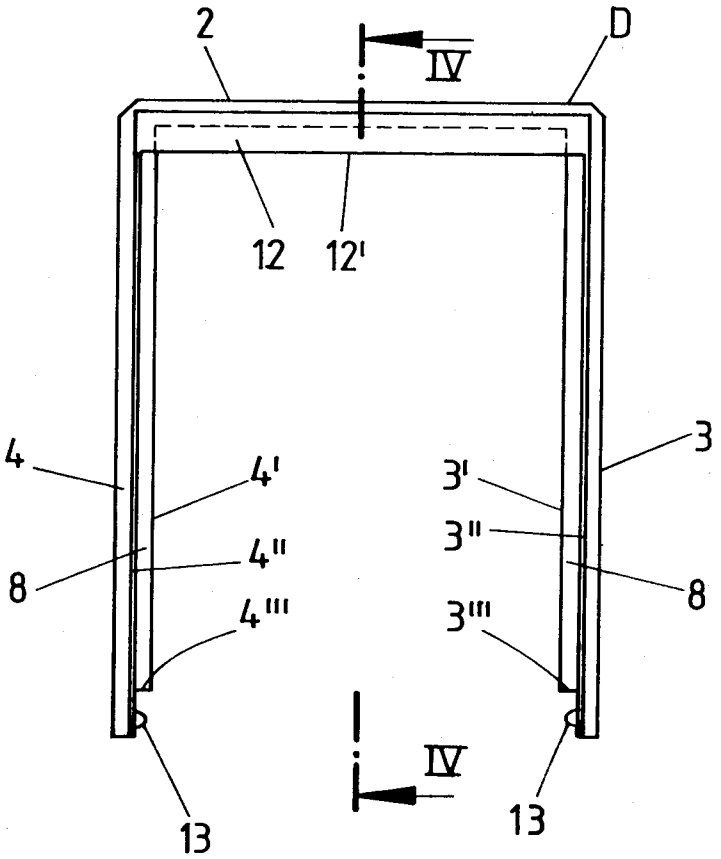
FIG. 3 is a side view of the U-shaped cover part.
Figure 4:
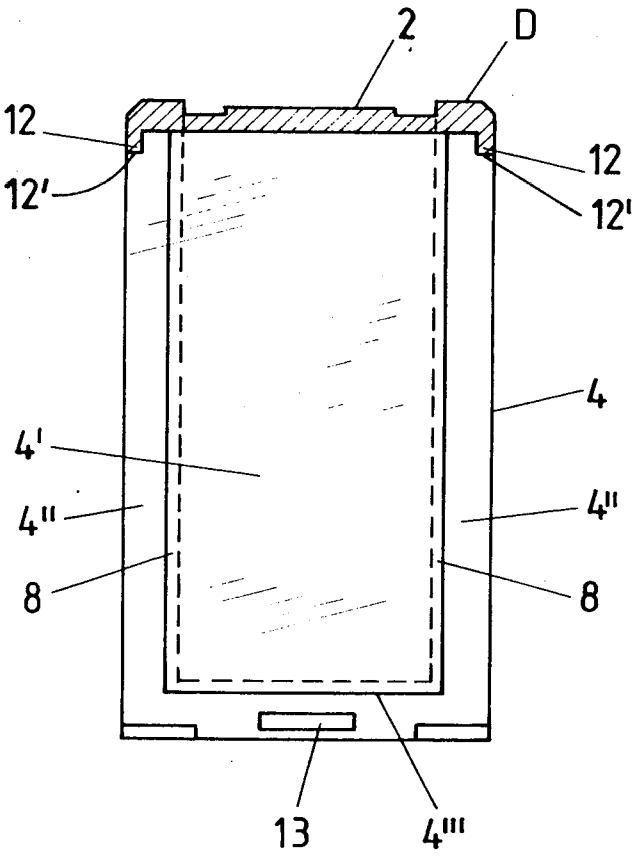
FIG. 4 is a cross-sectional view along line IV—IV of FIG. 3.
Figure 6:
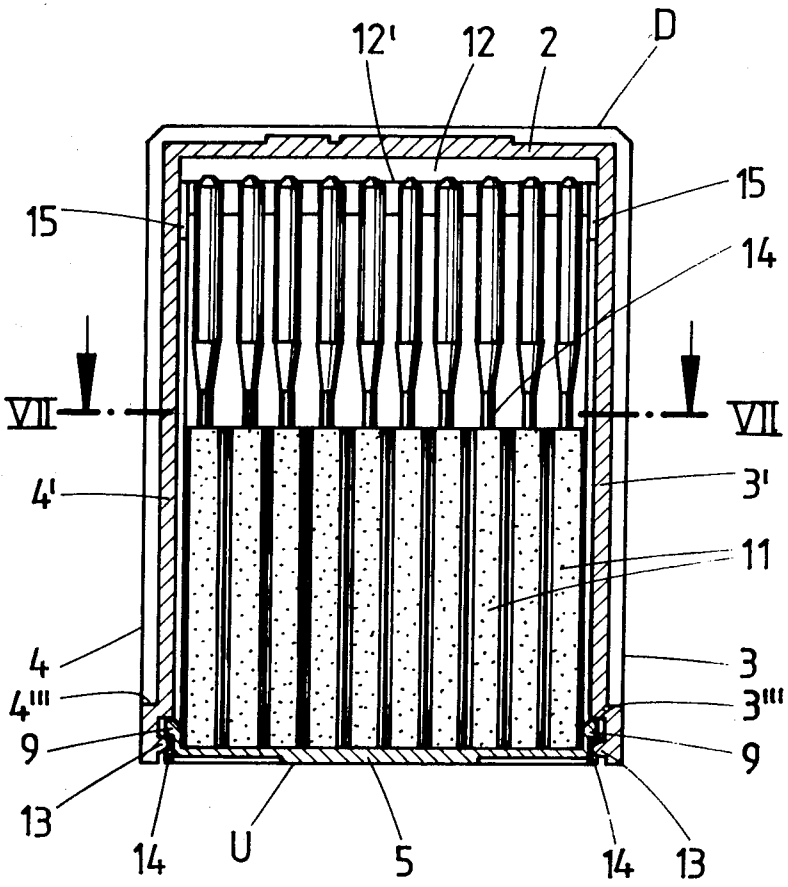
FIG. 6 is a cross-sectional view taken along line VI—VI of FIG. 5 with the cover part being shown in section.
Figure 5:
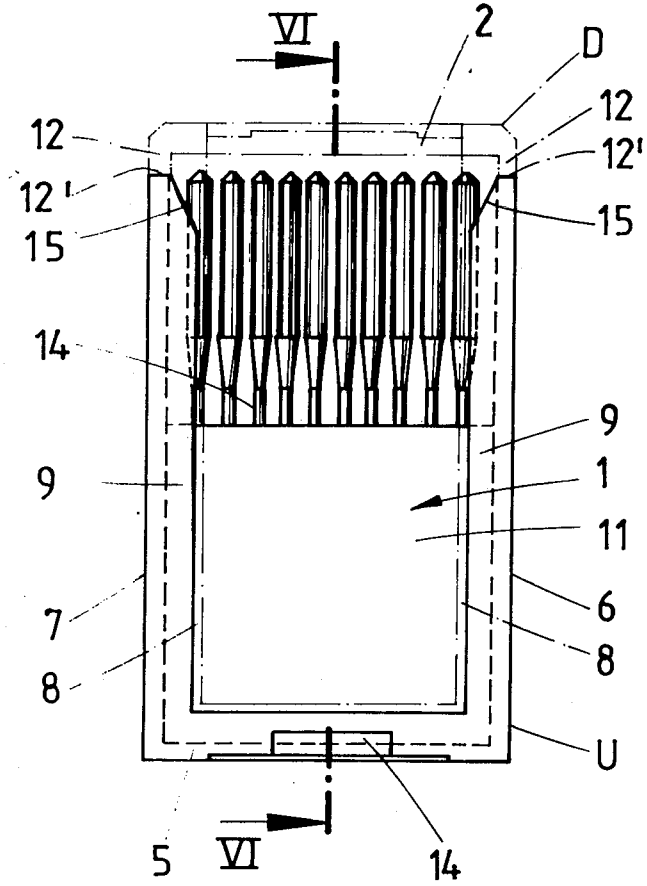
FIG. 5 is an end view of the U-shaped bottom part carrying inserted sewing machine needle packages, with the cover part being indicated by broken lines.

The bottom part U and the cover part D each have a U-shaped configuration (see FIGS. 3 and 5).

The U-web 2 of the cover part D forms the top wall of the overcase; the U-shanks 3, 4 form two equally long and wide sidewalls.

The overall configuration of the bottom part U is similar to cover part D. The web 5 functions as a bottom wall, while the U-shanks 6 and 7 originating from it extend as upward side walls. Shanks 6 and 7 are of equal length and equal width.

With their U-shanks 3, 4 and 6, 7, respectively, in a position offset by 90°, the bottom part U and the cover part D can be slipped together in the fashion of a claw-type clutch with the U-shanks 3, 4 of the cover part D being guided between the marginal edges 6', 7' of the U-shanks 6, 7 of the bottom part U.

To provide such a marginal edge guidance, the inside surfaces of the U-shanks 3, 4 of the cover part D extend inwardly in the area of a center panel portion 3', 4', respectively. The edges of the center panels form offset guide shoulders 8 which extend in a slip-in direction and partially protrude, along with the panels forming them, in the U-space of the bottom part U. The marginal strip portions 3'' and 4'' of the inside surfaces of the U-shanks that are not inwardly offset abut narrow marginal edges 6', 7' of the U-shanks 6, 7 of the bottom part U.

Figure 7:
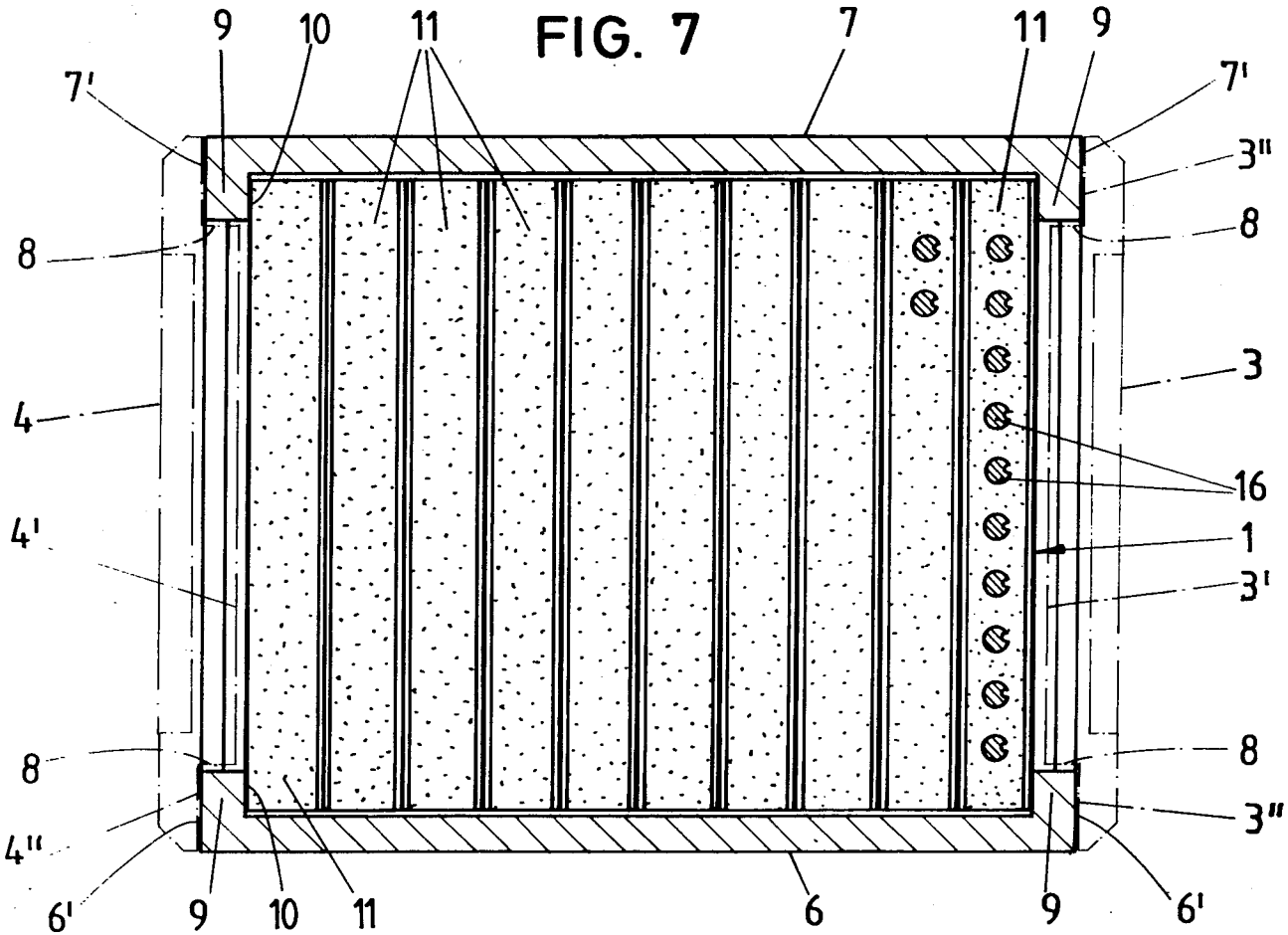
FIG. 7 is an enlarged cross-sectional view of the overcase and contents taken along line VII—VII of FIG. 6.

As shown in FIG. 7, both the marginal edges 6', 7' of the U-shanks 6, 7 and those of the U-web 5 extend perpendicular to the adjacent wall. These marginal edges form stabilizing marginal ridges 9 both on the U-shanks 6 and the webs of the bottom part U. This results in a more stable attachment of the U-shanks to the bottom part web. In addition, a bearing shoulder 10 is formed on the inside for sewing machine needle packages 1. Packages 1 are conveniently formed as a flat packing panel 11. Consequently, these packages cannot topple out of the lateral U-opening forming a window. As shown in FIG. 3, the marginal edges of the U-web 2 forming the top wall extend downwardly into the area of the U-opening as well as at a 90° angle to the top wall so that the U-shanks 3 and 4 are in the area near the U-web connected by a stabilizing strip 12. The lower edges of strips 12' point toward the U-space, i.e., down, and bear on the closed position of the overcase on the corresponding upper edges of the U-shank 6, 7 of the bottom part U (see FIG. 5).

The bottom part U and cover part D are releasably locked in the closed position. The two U-shanks 3 and 4 which are stiffened by the offset panels are utilized for that purpose. These shanks carry on their inner surfaces, in the area of their free ends, locking projections 13 which are directed toward the marginal ridge 9 on the bottom side. These projections engage openings 14 on opposite sides of the U-shank 5, i.e., in the marginal ridges 9 on the bottom. The lower narrow edges 3''' and 4''', respectively, of the recessed panels 3' and 4', respectively, bear in limit stop fashion against the upper edges of marginal ridges 9 formed on inner wall 5.

To obtain a self-centering alignment of the cover part D, the upper end section of the marginal ridges 9 of the U-shanks 6, 7 forming the support shoulders 10 each include a bevel 15.

A preferred form of overcase will hold ten sewing machine needle packages 1. The packing panels 11 of these packages stand in parallel alignment side-by-side in contact with one another. Their end faces engage the inside faces of the U-shanks 6 and 7. In one form of needle package 1, these panels are foam material bodies having a firm structure. Needles 16 are pressed into panels 11. The butts of needles 16, including the shoulder and part of the shaft, are exposed above the upper narrow edge of the packing panel 11 to facilitate removal, while the more sensitive remaining portion forming the tip is embedded and protected.

The needle shafts of the last needles of the row adjacent to the open cross-section between the U-shanks 6, 7, e.g., the needle row of the last package, can be freely swung out of this "window" for convenient withdrawal of the needles, while the top of the panel bears on the support shoulders 10 which retains the package panel inside the overcase.

From the above disclosure of the general principles of the present invention and the preceding description of a preferred embodiment, those skilled in the art will readily comprehend various modifications to which the present invention is susceptible. Therefore, we desire to be limited only by the scope of the following claims.

Having described our invention, we claim:

1. An overcase for sewing machine needle packages, said overcase comprising:

a bottom member, a top member adapted to be slipped over said bottom member, said bottom member being of U-shaped configuration including two spaced parallel shanks and a web portion interconnecting said shanks, said shanks forming two side walls and said web forming a bottom wall of said overcase, said cover member being of U-shaped configuration and including two spaced parallel shanks and a web interconnecting said shanks, said last named shanks forming two side walls of said overcase and said last named web forming a top wall of said overcase, said cover member being slideable over said bottom member with the shanks of said cover member being offset 90° from the shanks of said bottom member, and means guiding said shanks of said cover member for sliding movement over substantially the entire length of said shanks of said bottom member, said guiding means being disposed in engagement with the inner surface of said shanks of said cover member, whereby said shanks of said cover member are free to spread outwardly to permit removal of said cover member by sliding said cover member relative to said bottom member.

2. The overcase of claim 1 in which said guiding means comprise an inwardly offset central panel on each of said shanks of said cover member, said panels forming guide edges and marginal shoulders on said shanks of the bottom member disposed for engagement with said guide edges.

3. The overcase of claim 2 in which said marginal shoulders extend at 90° to said shanks on said bottom member.

4. The overcase of claim 1 further comprising a strip adjacent to the web of said cover member, said strip interconnecting said shanks of said cover member.

5. The overcase of claim 3 further comprising support shoulders extending upwardly from said web on said bottom member, said last named support shoulders and said marginal support shoulders being adapted to restrain said needle packages.

6. The overcase of claim 5 further comprising projections carried by the free ends of said shanks on said cover member and recesses for receiving said projections formed in said web portion of the bottom part, said last named shanks being sufficiently flexible to permit disengagement of said projections from said recesses when said cover member is slid in a direction away from said bottom part.

* * * * *